US008936534B2

(12) United States Patent
Chen et al.

(10) Patent No.: US 8,936,534 B2
(45) Date of Patent: Jan. 20, 2015

(54) FREE WALKING TRAINING MACHINE

(75) Inventors: Chun-Ho Chen, Taichung (TW); Chia-Hsun Chuang, Taichung (TW)

(73) Assignee: Cycling & Health Tech Industry R&D Center, Taichung (TW)

( * ) Notice: Subject to any disclaimer, the term of this patent is extended or adjusted under 35 U.S.C. 154(b) by 146 days.

(21) Appl. No.: 13/616,233

(22) Filed: Sep. 14, 2012

(65) Prior Publication Data

US 2013/0316878 A1 Nov. 28, 2013

(51) Int. Cl.
*A63B 22/00* (2006.01)

(52) U.S. Cl.
USPC ..... 482/52; 482/51

(58) Field of Classification Search
CPC .. A63B 22/00; A63B 22/0006; A63B 22/001; A63B 22/046
USPC ..... 482/52, 51, 62, 130
See application file for complete search history.

(56) References Cited

U.S. PATENT DOCUMENTS 6,152,859 A * 11/2000 Stearns ..... 482/52
6,196,948 B1 * 3/2001 Stearns et al. ..... 482/52
6,485,395 B1 * 11/2002 Stearns et al. ..... 482/57
7,785,235 B2 * 8/2010 Lull et al. ..... 482/52
8,021,275 B2 * 9/2011 Rodgers, Jr. ..... 482/52
8,092,351 B1 * 1/2012 Rodgers, Jr. ..... 482/52
8,529,413 B2 * 9/2013 Simmons ..... 482/100
8,690,737 B2 * 4/2014 Van Straaten ..... 482/52
2011/0281690 A1 * 11/2011 Van Straaten ..... 482/52

* cited by examiner

*Primary Examiner* — Loan H Thanh
*Assistant Examiner* — Rae Fischer
(74) *Attorney, Agent, or Firm* — Muncy, Geissler, Olds & Lowe, P.C.

(57) ABSTRACT

A free walking training machine includes a chassis having a left supporting frame and a right supporting frame, a left swing arm having a left axial portion extending laterally, a right swing arm having a right axial portion extending laterally, a left lifting mechanism, a right lifting mechanism, a first linking unit, and a second linking unit. The left lifting mechanism makes the left swing arm move upward and downward relative to the left supporting frame. The right lifting mechanism makes the right swing arm move upward and downward relative to the right supporting frame. The first and second linking mechanisms are connected with the left and right swing arms for enabling the left and right axial portions and the left and right swing arms to make coordinated movement and move in opposite directions, respectively. The first and second linking mechanisms are operable independently.

11 Claims, 9 Drawing Sheets

FREE WALKING TRAINING MACHINE

BACKGROUND OF THE INVENTION

1. Field of the Invention

The present invention relates generally to a fitness apparatus, and more particularly, to a free walking training machine simulating human walking patterns for a user.

2. Description of the Related Art

Serving as a walking-pattern trainer, most of the currently commercially available elliptical exercise machines have fixed exercise trajectories to limit exercise types thereof. The elliptical exercise machine can though adjust the exercise trajectory via an actuator, but the operational speed of the actuator is slower and fails to completely satisfy the user's need for quick change of walking patterns, so the user fails to adjust his or her walking span or exercise pattern.

In view of the practical limitation of the conventional walking trainers, how to effectively improve such drawback is the purpose of the present invention.

SUMMARY OF THE INVENTION

The primary objective of the present invention is to provide a free walking training machine, which can immediately adjust operational trajectory subject to the swing span and direction of the user's legs.

The secondary objective of the present invention is to provide a free walking training machine, which can simulate exercise patterns, like glissade exercise, treading exercise with elliptical trajectory, and stationary walking exercise.

The foregoing objectives of the present invention are attained by the free walking training machine composed of a chassis having a left supporting frame and a right supporting frame, a left swing arm having a left treadle and a left axial portion extending laterally, a right swing arm having a right treadle and a right axial portion extending laterally, a left lifting mechanism, a right lifting mechanism, a first linking unit, and a second linking unit. The left lifting mechanism is mounted between the left axial portion and the left supporting frame in such a way that the left swing arm is movable upward and downward relative to the left supporting frame. The right lifting mechanism is mounted between the right axial portion and the right supporting frame in such a way that the right swing arm is movable upward and downward relative to the right supporting frame. The first linking mechanism is connected with the left and right swing arms or between the left and right lifting mechanisms for enabling the left and right axial portions to make coordinated movement and move in opposite directions (upwards or downwards), respectively. The second linking mechanism is connected with the left and right swing arms for enabling the left and right swing arms to make coordinated movement and swing in opposite directions on the left and right axial portions, respectively. The first and second linking mechanisms are operable independently from each other.

By means of the first and second linking mechanisms, the left and right swing arms can be movable upwards and downwards or pivotable in opposite directions. Because the operations of the first and second linking mechanisms are independent from each other, the upward and downward movement and the pivoting movement of the left and right swing arms can proceed, respectively, or together. In this way, higher degree of freedom of trajectory can be available to enable the left and right swing arms to follow swing spans and directions of the user's legs and to facilitate simulation of the glissade exercise, treading exercise, and stationary treading exercise for the user.

DETAILED DESCRIPTION OF PREFERRED EMBODIMENTS

Structural features and desired effects of the free walking training machine of the present invention will become more fully understood by reference to two preferred embodiments given hereunder. However, it is to be understood that these embodiments are given by way of illustration only, thus are not limitative of the claim scope of the present invention.

Figure 1:
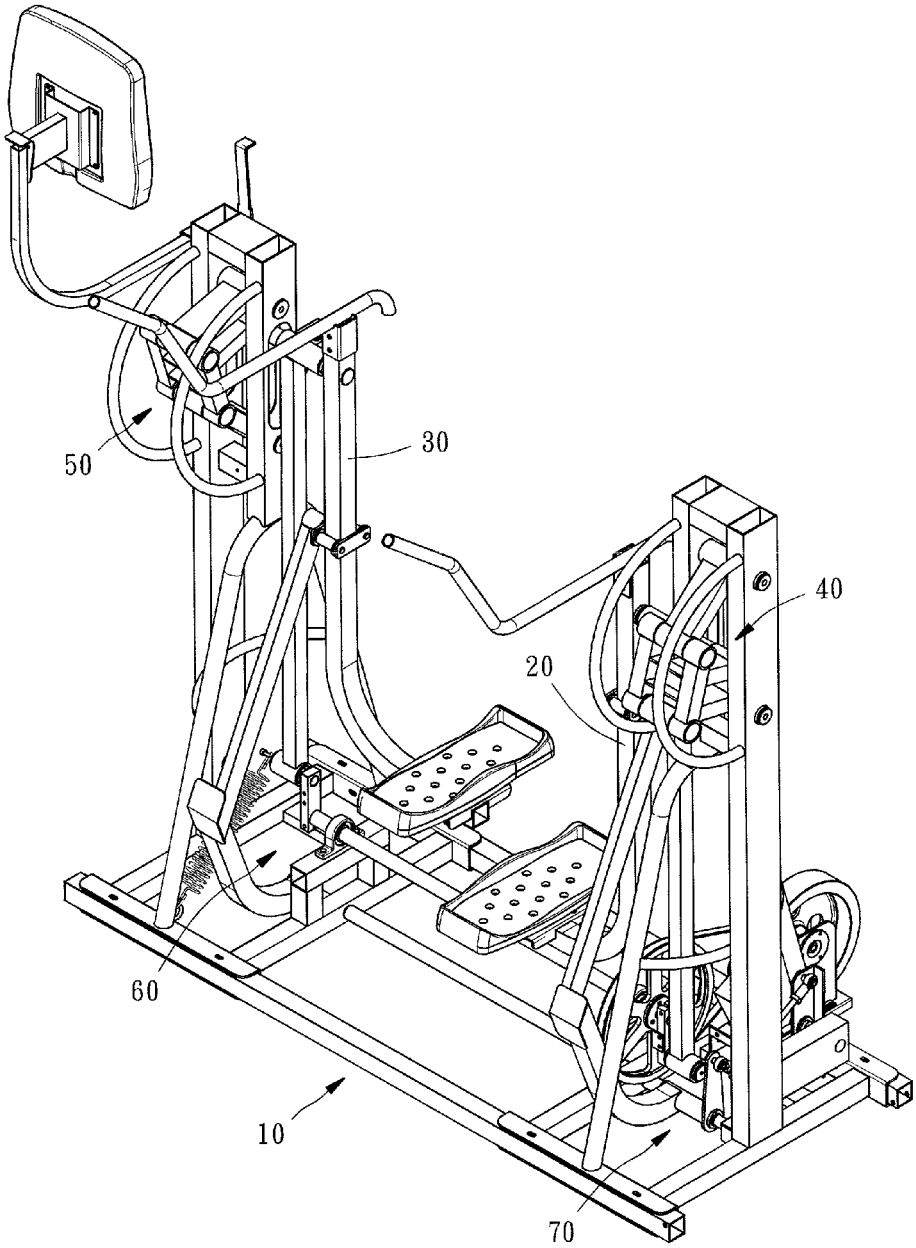
FIG. 1 is a perspective view of a first preferred embodiment of the present invention.

Referring to FIG. 1, a free walking training machine constructed according to a first preferred embodiment of the present invention is composed of a chassis 10, a left swing arm 20, a right swing arm 30, a left lifting mechanism 40, a right lifting mechanism 50, a first linking mechanism 60, and a second linking mechanism 70. The detailed descriptions and operations of these elements as well as their interrelations are recited in the respective paragraphs as follows. Note that the phrases "left" and "right" are defined based on the orientation while the user operates the free walking training machine as an example for illustration.

Figure 2:
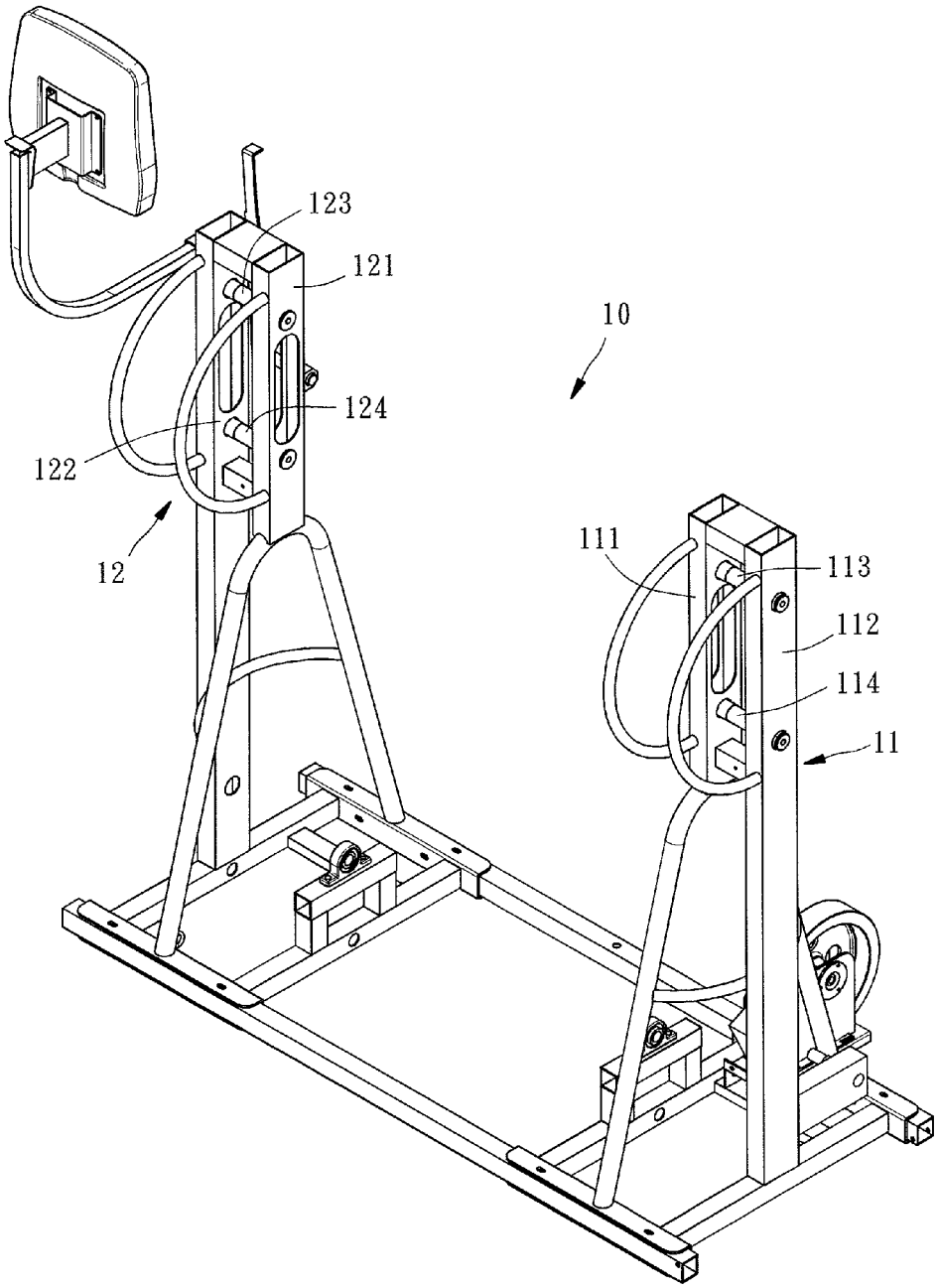
FIG. 2 is a perspective view of some parts of the first preferred embodiment of the present invention, illustrating the chassis.

Referring to FIG. 2 in view of FIG. 1, the chassis 10 includes a left supporting frame 11 and a right supporting frame 12. The left supporting frame 11 is formed of a first left supporting unit 111, a second left supporting unit 112, a first left axial bar 113, and a second left axial bar 114. The first and second left axial bars 113 and 114 are mounted between the first and second left supporting units 111 and 112. The right supporting frame 12 is formed of a first right supporting unit 121, a second right supporting unit 122, a first right axial bar 123, and a second right axial bar 124. The first and second right axial bars 123 and 124 are mounted between the first and second right supporting units 121 and 122.

Figure 3:
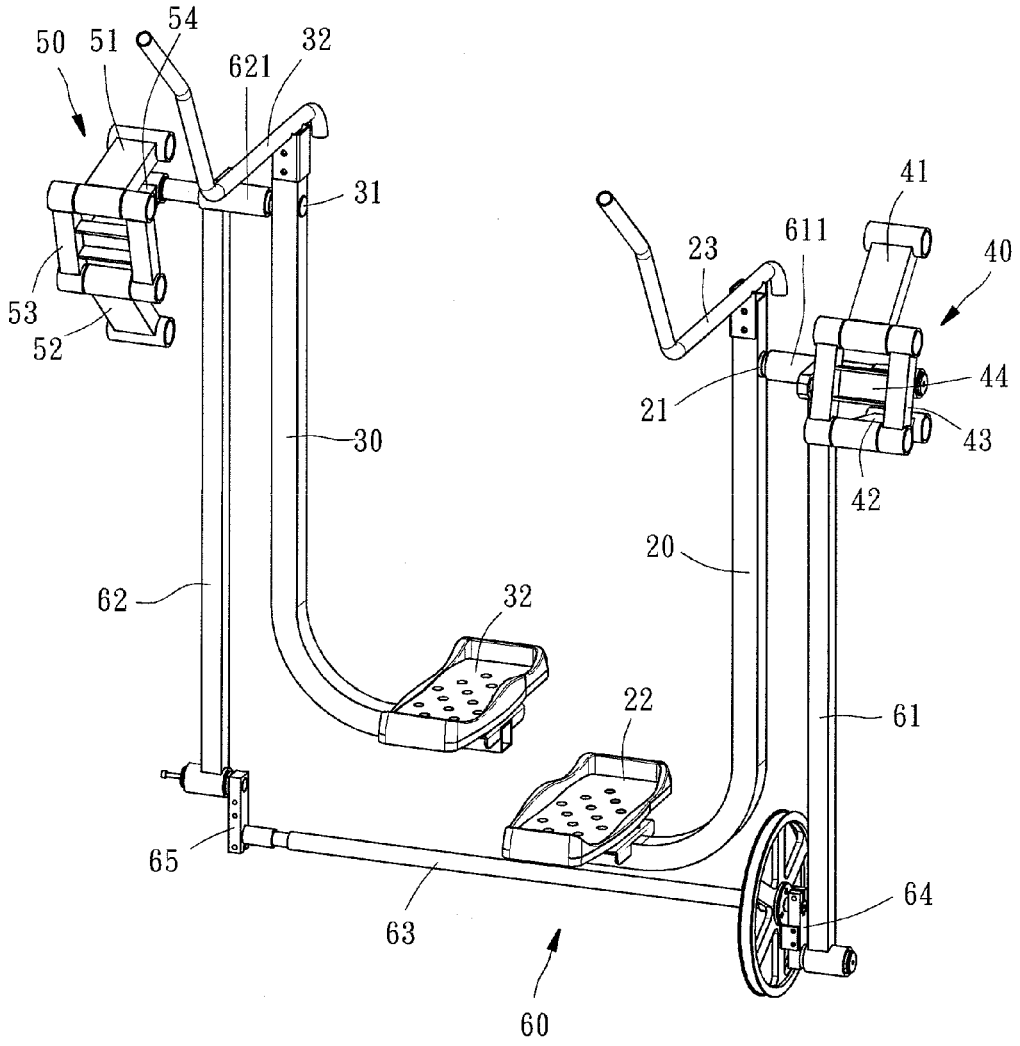
FIG. 3 is a perspective view of some parts of the first preferred embodiment of the present invention, illustrating the swing arms, the lifting mechanisms, and the first linking mechanism.

Further referring to FIG. 3, in this embodiment, the left swing arm 20 includes a left axial portion 21 extending laterally, a left treadle 22 located at a bottom end thereof, and a left handrail 23 located at a top end thereof. The right swing arm 30 includes a right axial portion 31 extending laterally, a right treadle 32 located at a bottom end thereof, and a right handrail 33 located at a top end thereof.

Referring to FIGS. 1-3 again, the left lifting mechanism 40 is mounted between the left axial portion 21 and the left supporting frame 11, and the left swing arm 20 is movable upward and downward relative to the left supporting frame 11. Specifically, in this embodiment, the left lifting mechanism 40 includes a first left rocker bar 41 pivotably mounted to the first left axial bar 113, a second left rocker bar 42 pivotably mounted to the second left axial bar 114, a left follower bar 43 pivotably connected between the first and second rocker bars 41 and 42, and a left driving bar 44 having two ends, one of which is pivotably mounted to the left axial portion 21 and the other is connected with the left follower bar 43.

In addition, the right lifting mechanism 50 includes a first right rocker bar 51 pivotably mounted to the first right axial bar 123, a second right rocker bar 52 pivotably mounted to the second right axial bar 124, a right follower bar 53 pivotably connected between the first and second right rocker bars 51 and 52, and a right driving bar 54 having two ends, one of which is pivotably mounted to the right axial portion 31 and the other is connected with the right follower bar 53.

In light of the aforesaid structure, the left and right lifting mechanisms 40 and 50 cannot only limit the moving trajectories of the left and right axial portions 21 and 32 to respective approximately straight lines but have sufficient strength for bearing heavier load and greater sideward stress.

Referring to FIG. 3 again, the first linking mechanism 60 is connected with the left and right swing arms 20 and 30 for enabling the left and right axial portions 21 and 31 to make coordinated movement and to move in opposite directions (upward or downward). Specifically, the first linking mechanism 60 includes a left upright linking bar 61 having a top end pivotably connected with the left axial portion 21, a right upright linking bar 62 having a top end pivotably connected with the right axial portion 31, a rotary shaft 63 rotatably mounted to the chassis 10, a left crank 64 having two ends, one of which is synchronically rotatably connected with the rotary shaft 63 and the other is pivotably connected with the left upright linking bar 61, and a right crank 65 having two ends, one of which is synchronically rotatably connected with the rotary shaft 63 and the other is pivotably connected with the right upright linking bar 62. The left upright linking bar 61 has a top end pivotably sleeved to the left axial portion 21 via a left axial sleeve 611. The right upright linking bar 62 has a top end pivotably sleeved to the right axial portion 31 via a right axial sleeve 621. Further, the orientation phase difference between the left and right cranks 64 and 65 is 180 degrees to enable the left and right axial portions 21 and 31 to make coordinated movement and to move in the opposite directions (upward or downward).

Figure 4:
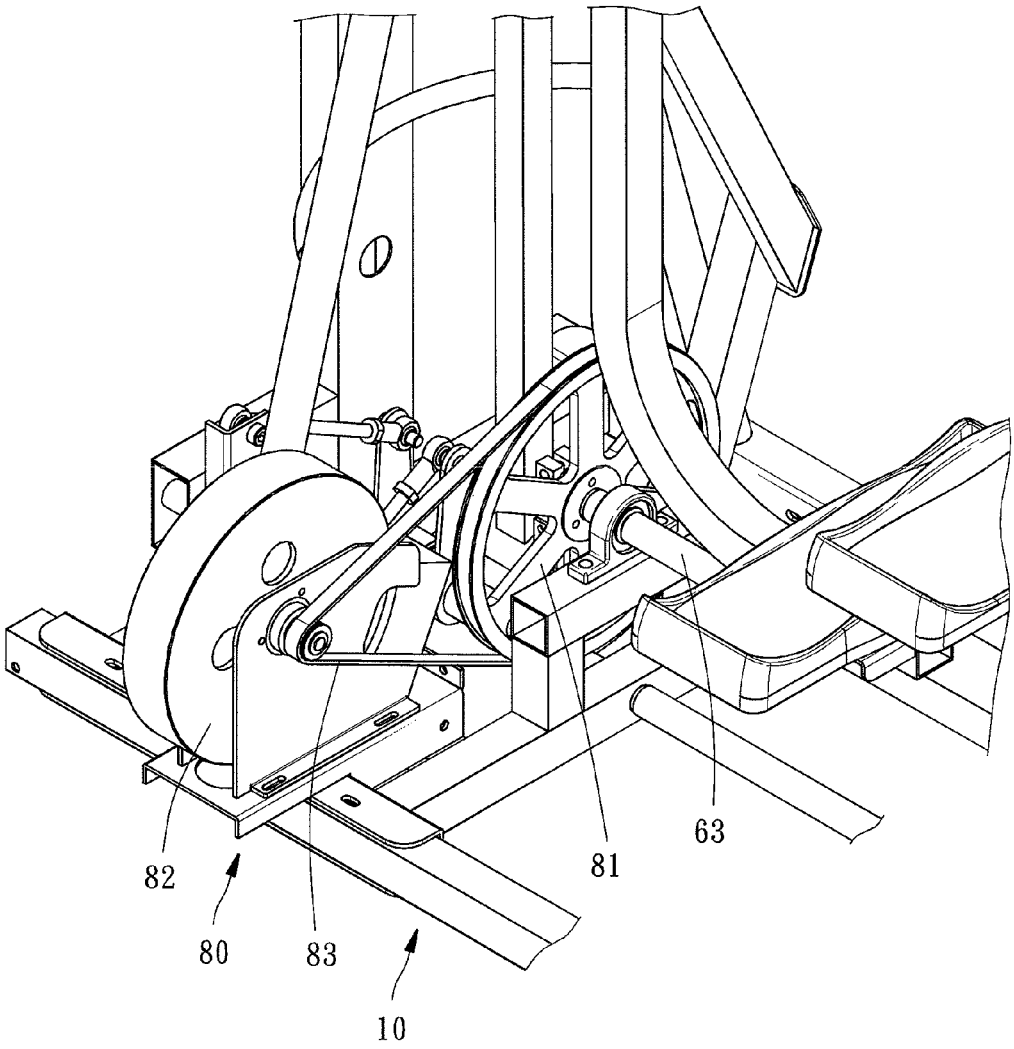
FIG. 4 is a perspective view of some parts of the first preferred embodiment of the present invention, illustrating the damper.

Referring to FIG. 4, to reach the exercise effect, the free walking training machine of the present invention can further include a damper 80 formed of a driving wheel 81 coaxially and synchronically rotatably mounted to the rotary shaft 63, a damping flywheel 82 mounted to the chassis 10, and a transmission belt 83 running around between the driving wheel 81 and the damping flywheel 82. The damping flywheel 82, like a magnetic flywheel, can adjust damping coefficient subject to variation of magnetic force.

Figure 5:
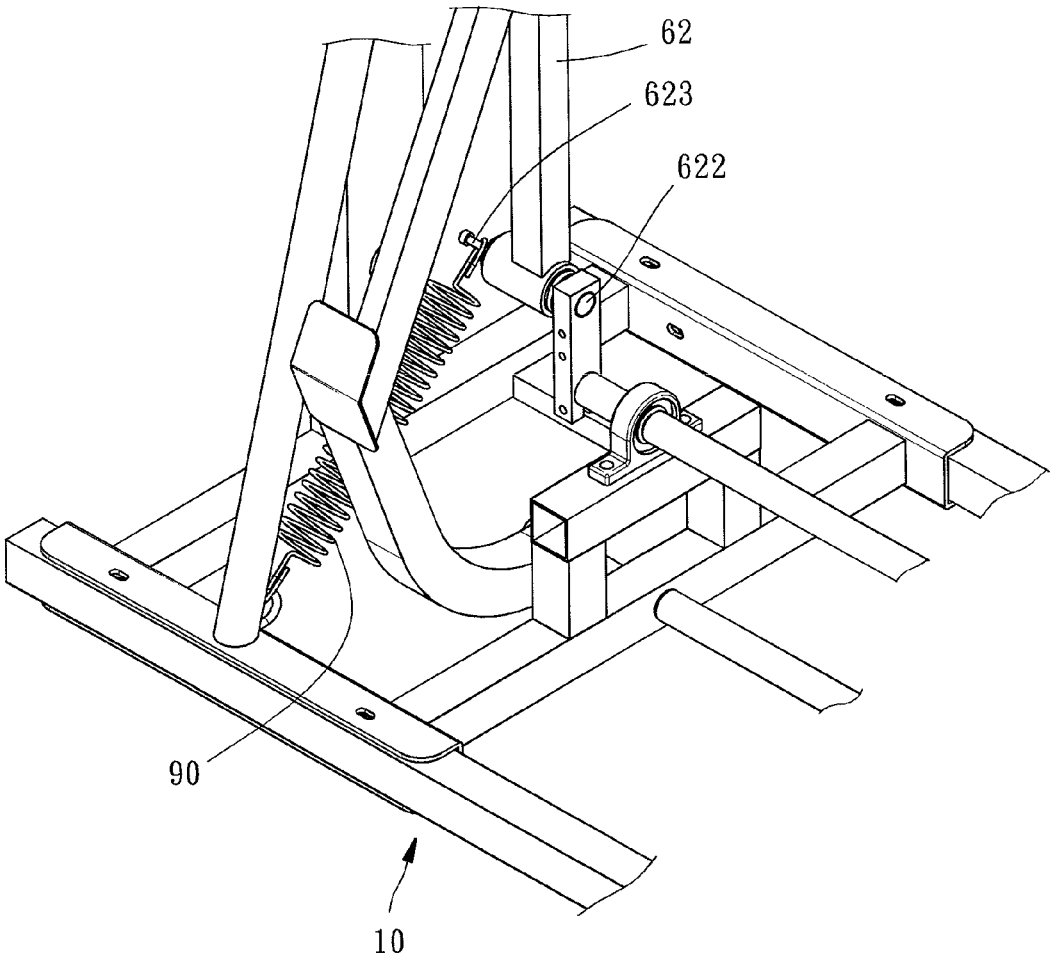
FIG. 5 is a perspective view of some parts of the first preferred embodiment of the present invention, illustrating the springy member.

Referring to FIG. 5, to help the left and right cranks 64 and 65 of the first linking mechanism 60 smoothly pass dead points, the free walking training machine of the present invention can further include a springy member 90 mounted between a pivotal shaft 622, located at a bottom end of the right upright linking bar 62, and the chassis 10. The pivotal shaft 622 has a linking bar 623 transversally protruding outward for engagement with one end of the springy member 90 for providing the right upright linking bar 62 with a resilient preload off the upright direction. The number of the springy member 90 is variable subject to requirement. Alternatively, the springy member 90 can be mounted between the left upright linking bar 61 and the chassis 10.

Figure 6:
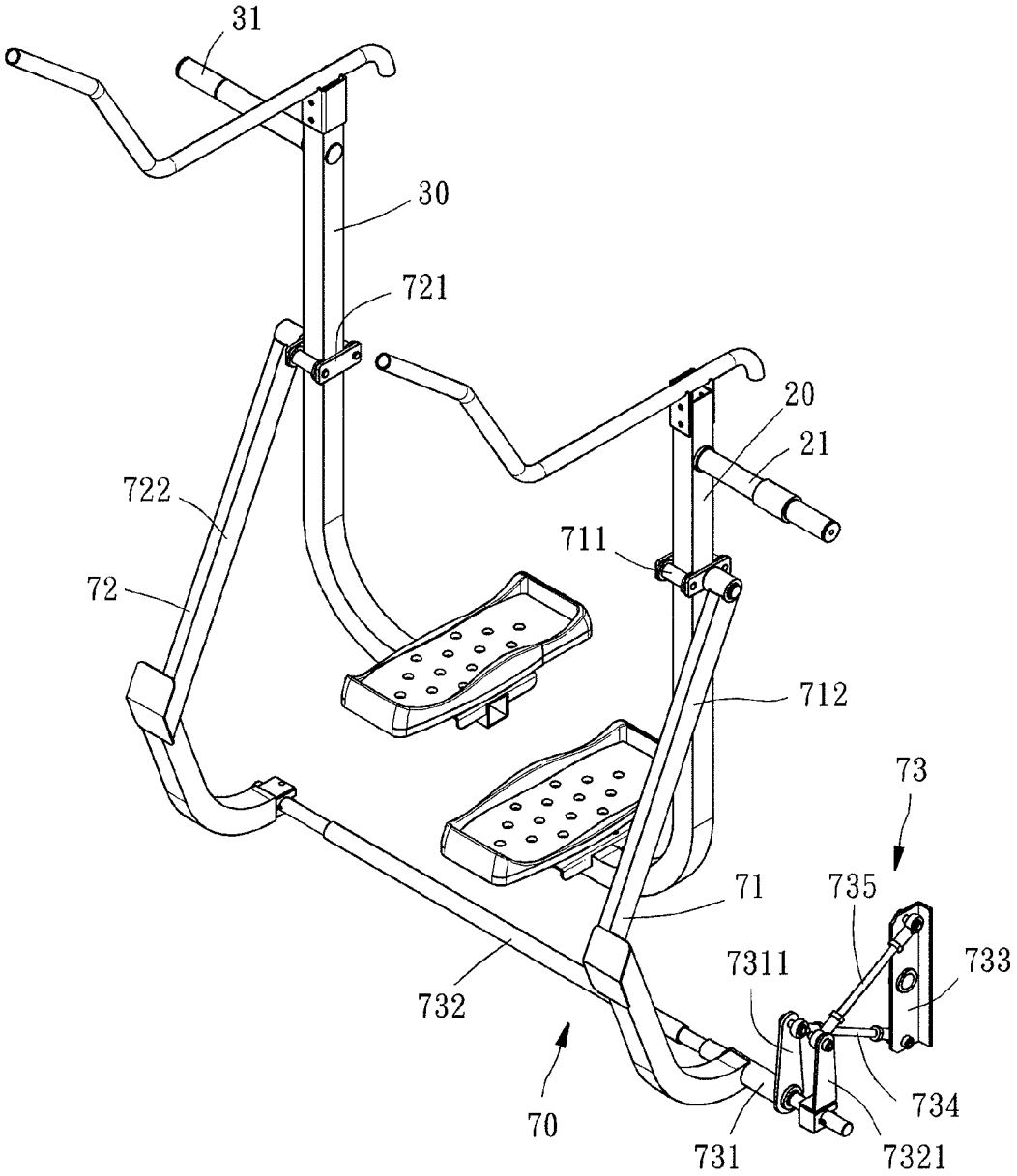
FIG. 6 is a perspective view of some parts of the first preferred embodiment of the present invention, illustrating the swing arms and the second linking mechanism.

Referring to FIG. 6, in this embodiment, the second linking mechanism 70 is connected with the left and right swing arms 20 and 30 for enabling the left and right swing arms 20 and 30 to make coordinated movement and to swing in opposite directions on the left and right axial portions 21 and 31. Further, the second linking mechanism 70 includes a left pivotable linking bar 71 having a top end slidably pivotably connected with the left swing arm 20, a right pivotable linking bar 72 having a top end slidably pivotably connected with the right swing arm 30, and a linking unit 73 connected with the left and right pivotable linking bars 71 and 72. The left and right pivotable linking bars 71 and 72 are coaxially and synchronically pivotable in opposite directions. In this embodiment, the left pivotable linking bar 71 includes a left slide sleeve 711 slidably sleeved to the left swing arm 20, and a left bar 712 having a top end pivotably connected with the left slide sleeve 711. The right pivotable linking bar 72 includes a right slide sleeve 721 slidably sleeved to the right swing arm 30, and a right bar 722 having a top end pivotably connected with the right slide sleeve 721. In this way, the slidably pivotable connection can be reached. The linking unit 73 is connected with the left and right bars 712 and 722. The first and second linking mechanisms 60 and 70 are operable independently from each other; namely, the first and second linking mechanisms 60 and 70 can work at the same time but be neither connected with each other nor contact each other, so their operations do not interfere with each other.

Figure 7:
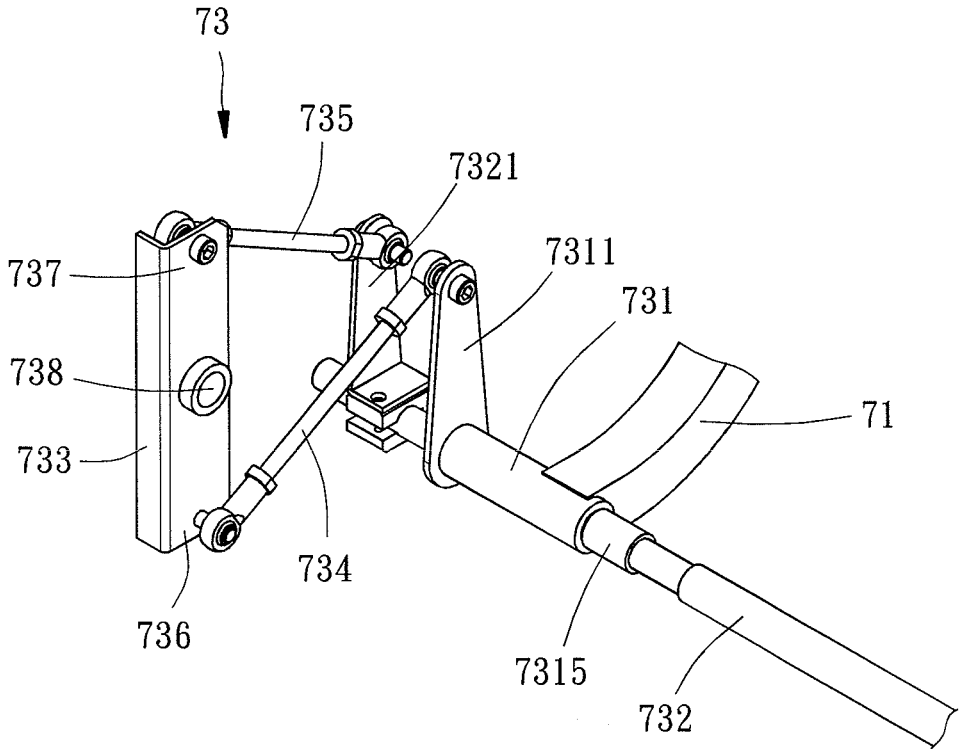
FIG. 7 is a perspective view of a part of the first preferred embodiment of the present invention, illustrating the linking unit of the second linking mechanism.

Referring to FIG. 7, in this view, the linking unit 73 includes a left rotary shaft 731 connected with a bottom end of the left pivotable linking bar 71, a right rotary shaft 732 connected with a bottom end of the right pivotable linking bar 72 and coaxial with the left rotary shaft 731, a left rotary-shaft crank 7311 connected with the left rotary shaft 731, a right rotary-shaft crank 7321 connected with the right rotary shaft 732, a lever 733, a first pushrod 734, and a second pushrod 735. The right rotary shaft 732 has a part sleeved into the left rotary shaft 731 and a bushing or a bearing 7315 is mounted between the left and right rotary shafts 731 and 732. The lever 733 has a first end 736, a second end 737, and a fulcrum 738 pivotably connected with the chassis 10 and located between the first and second ends 736 and 737. The first pushrod 734 is connected between the left rotary-shaft crank 7311 and the first end 736 of the lever 733. The second pushrod 735 is connected between the right rotary-shaft crank 7321 and the second end 737 of the lever 733. The lever 733 is pivotable on the fulcrum 738 to drive the left and right rotary-shaft cranks 7311 and 7321 to synchronically pivot in opposite directions so that the pivotable directions of the left and pivotable linking bars 71 and 72 can be controlled to be opposite to each other.

Figure 8:
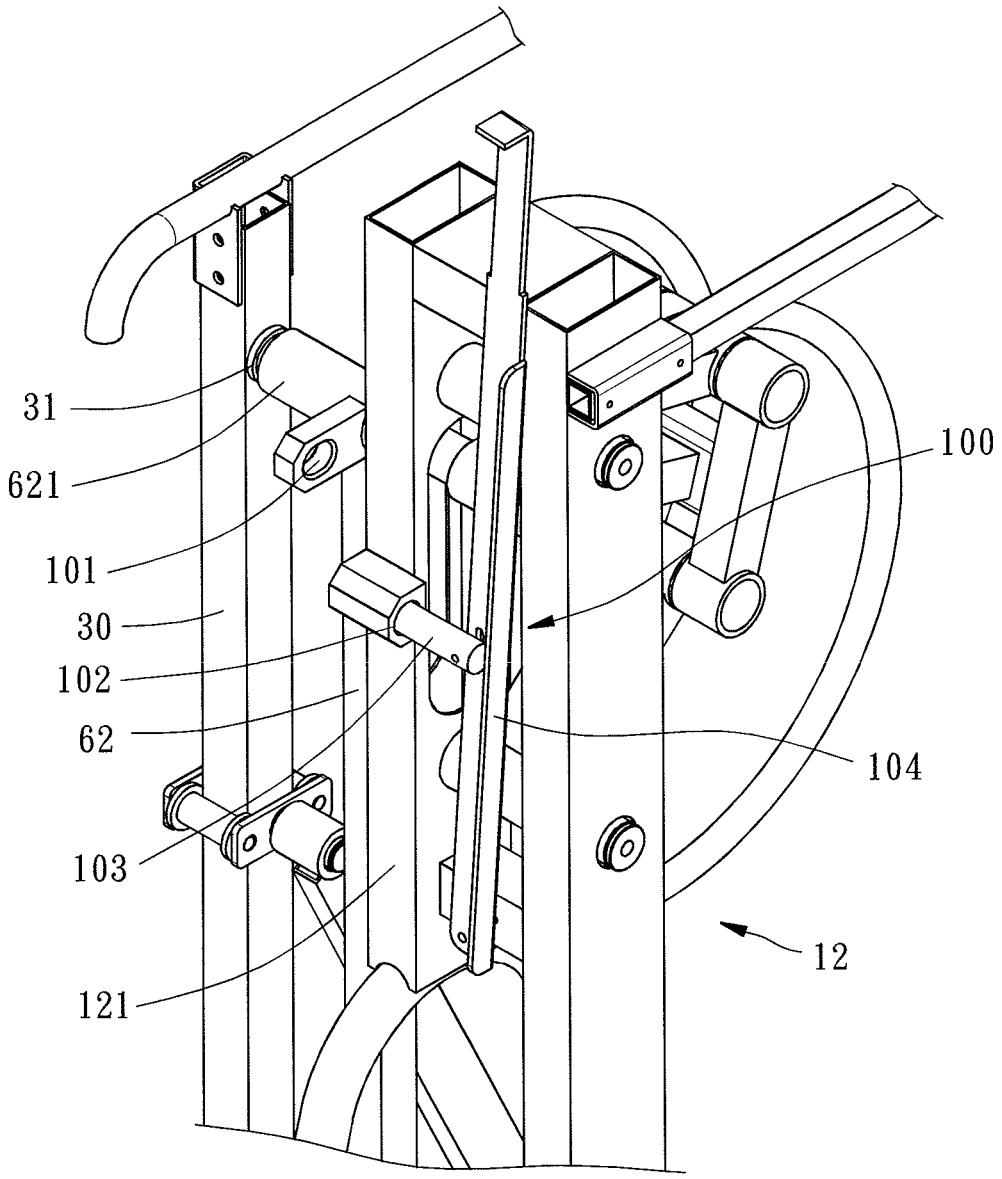
FIG. 8 is a partial perspective view of some parts of the first preferred embodiment of the present invention, illustrating the locking device.

Referring to FIG. 8, in this embodiment, the free walking training machine of the present invention further includes a locking device 100 formed of a first slot 101 formed at the right axial sleeve 621, a second slot 102 formed at the first right supporting unit 121, a pin 103 selectively inserted into the first and second slots 101 and 102, and a swivel bar 104 rotatably mounted to the right supporting frame 12 and pivotably connected with the pin 103. Alternatively, the first and second slots 101 and 102 can be interchangeably formed at the left upright linking bar 61 and the first left supporting unit 111, respectively. However, the locking device 100 can be excluded in practice.

When the pin 103 is inserted into the first and second slots 101 and 102 at the same time, the left and right axial portions 21 and 31 are prohibited from upward and downward movement relative to the left and right supporting frames 11 and 12; meanwhile, the first linking mechanism 60 is not workable and the second linking mechanism 70 is workable to drive the left and right swing arms 20 and 30 to alternately swing for the user to simulate the glissade exercise. When the pin 103 is inserted into the second slot 102 only, the left and right axial portions 21 and 31 can move upwardly and downward relative to the left and right supporting frames 11 and 12. Thus, the user can simulate stationary treading exercise if only the first linking mechanism 60 is workable or simulate treading exercise with elliptical trajectory if the first and second linking mechanisms 60 and 70 are workable at the same time. While each of the aforesaid exercises is simulated, all of the exercise trajectories of the left and right treadles 22 and 23 have high degree of freedom to be shiftable as the spans and directions of swing of the user's legs are changed.

Figure 9:
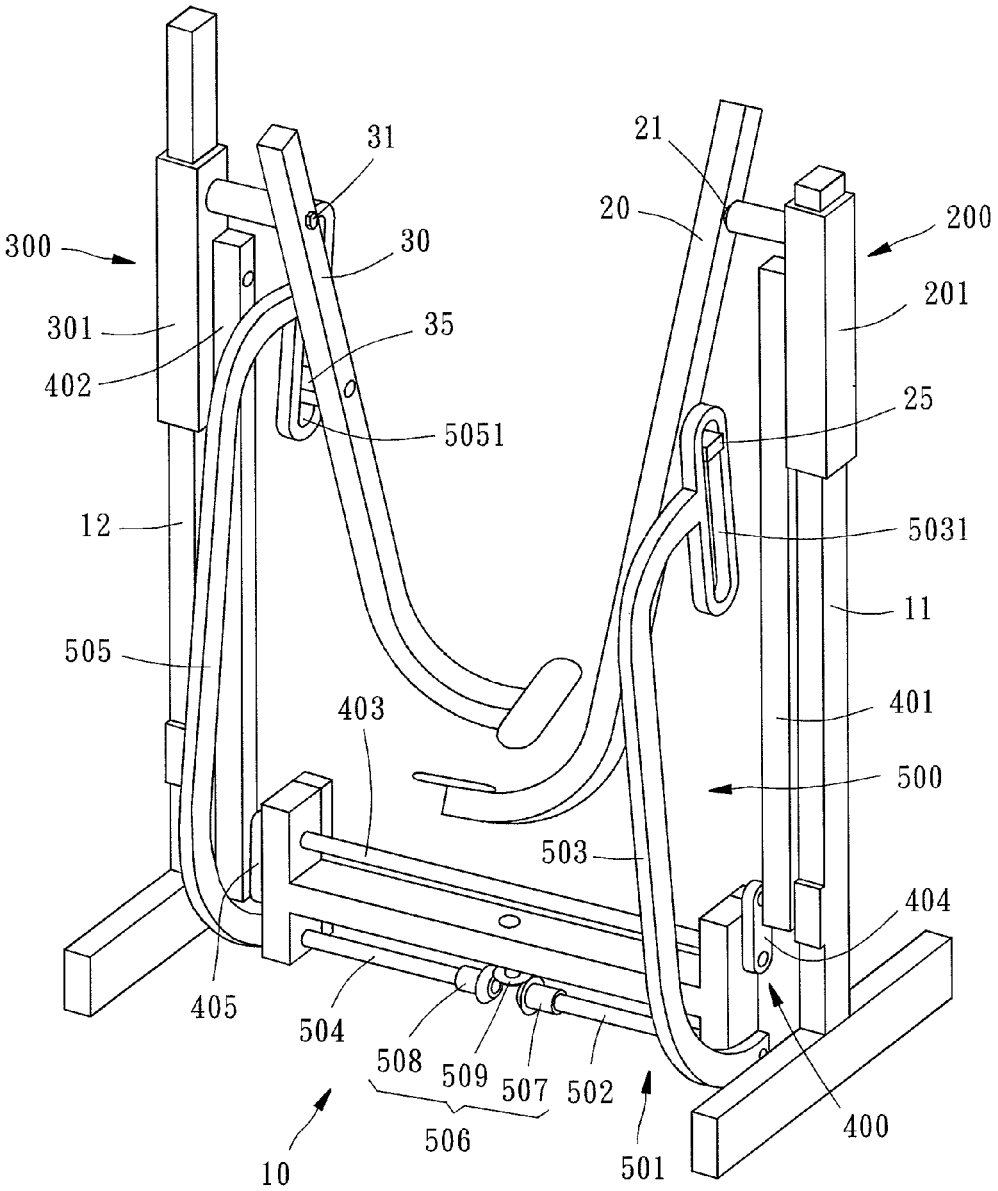
FIG. 9 is a perspective view of some parts of a second preferred embodiment of the present invention.

For the record, the free walking training machine of the present invention is not structurally limited to what have been disclosed above. According to a second preferred embodiment, as shown in FIG. 9, the left lifting mechanism 200 includes a left slide sleeve 201 slidably mounted to the left supporting frame 11 to be movable upwardly and downwardly, and the left axial portion 21 is pivotably connected with the left slide sleeve 201; the right lifting mechanism 300 includes a right slide sleeve 301 slidably mounted to the right supporting frame 12 to be movable upwardly and downwardly, and the right axial portion 31 is pivotably connected with the right slide sleeve 301. In the second embodiment, the first linking mechanism 400 is connected with the left and right lifting mechanisms 200 and 300 and includes a left upright linking bar 401 having one end pivotably connected with the left slide sleeve 201, a right upright linking bar 402 having one end pivotably connected with the right slide sleeve 301, a rotary shaft 403 rotatably mounted to the chassis 10, a left crank 404 having two ends, one of which is synchronically rotatably connected with the rotary shaft 403 and the other is pivotably connected with a bottom end of the left upright linking bar 401, and a right crank 405 having two ends, one of which is connected with the rotary shaft 403 for synchronically coordinated movement and the other is pivotably connected with the bottom end of the right upright linking bar 402. The orientation phase difference between the left and right cranks 404 and 405 is likewise 180 degrees, so the left and right axial portions 21 and 31 can be controlled to move in opposite directions (upward or downward) and this structure is much more compact than that of the first embodiment.

In addition, in the second embodiment, the linking unit 501 of the second linking mechanism 500 is different from that of the first embodiment, having a left rotary shaft 502 connected with the left pivotable linking bar 503, a right rotary shaft 504 connected with the right pivotable linking bar 505, and a bevel gear set 506 connected between the left and right rotary shafts 502 and 504. The left and right pivotable linking bars 503 and 505 are slidably pivotably connected with a left slide member 25 protruding sideward from the left swing arm 20 and a right slide member 35 protruding sideward from the right swing arm 30 via a left slide groove 5031 formed at a top end of the left pivotable linking bar 503 and a right slide groove 5051 formed at a top end of the right pivotable linking bar 505, respectively, so that the left and right slide members 25 and 35 are slidably inserted into the left and right slide grooves 5031 and 5051, respectively. In this way, the slidably pivotable connection can be reached. The bevel gear set 506 includes a left bevel gear 507 axially connected with the left rotary shaft 502, a right bevel gear 508 axially connected with the right rotary shaft 504, and an intermediate bevel gear 509 mounted to the chassis 10 and engaged with the left and right bevel gears 507 and 508 at the same time in such a way that the left and right pivotable linking bars 503 and 505 can pivot in opposite directions alternately. In addition, this structure is much more compact than that of the first embodiment.

Although the present invention has been described with respect to specific preferred embodiments thereof, it is in no way limited to the specifics of the illustrated structures but changes and modifications may be made within the scope of the appended claims.

What is claimed is:

1. A free walking training machine comprising:

a chassis having a left supporting frame and a right supporting frame;

a left swing arm having a left treadle and a left axial portion extending laterally;

a right swing arm having a right treadle and a right axial portion extending laterally;

a left lifting mechanism mounted between the left axial portion and the left supporting frame for facilitating the left swing arm to be movable upwardly and downwardly relative to the left supporting frame;

a right lifting mechanism mounted between the right axial portion and the right supporting frame for facilitating the right swing arm to be movable upwardly and downwardly relative to the right supporting frame;

a first linking mechanism connected with the left and right swing arms for enabling the left and right axial portions to simultaneously move upwardly and downwardly in opposite directions; and a second linking mechanism connected with the left and right swing arms for enabling the left and right swing arms to simultaneously respectively swing about the left and right axial portions in opposite directions;

wherein the first and second linking mechanisms are operable independently from each other;

wherein the left supporting frame comprises a first left supporting unit, a second left supporting unit, a first left axial bar, and a second left axial bar, the first and second left axial bars being mounted between the first and second left supporting units; the left lifting mechanism comprises a first left rocker bar pivotably mounted to the first left axial bar, a second left rocker bar pivotably mounted to the second left axial bar, a left follower bar pivotably connected between the first and second left rocker bars, and a left driving bar having two ends, one of which is pivotably connected with the left axial portion and the other is connected with the left follower bar; the right supporting frame comprises a first right supporting unit, a second right supporting unit, a first right axial bar, and a second right axial bar, the first and second right axial bars being mounted between the first and second right supporting units; the right lifting mechanism comprises a first right rocker bar pivotably mounted to the first right axial bar, a second right rocker bar pivotably mounted to the second right axial bar, a right follower bar pivotably connected between the first and second right rocker bars, and a right driving bar having two ends, one of which is pivotably connected with the right axial portion and the other is connected with the right follower bar.

2. The free walking training machine as defined in claim 1, wherein the first linking mechanism comprises a left upright linking bar having an end pivotably connected with the left axial portion, a right upright linking bar having an end pivotably connected with the right axial portion, a rotary shaft rotatably mounted to the chassis, a left crank having two ends, one of which is synchronically rotatably connected with the rotary shaft and the other is pivotably connected with the left upright linking bar, and a right crank having two ends, one of which is synchronically rotatably connected with the rotary shaft and the other is pivotably connected with the right upright linking bar; wherein an orientation phase difference between the left and right cranks is 180 degrees.

3. The free walking training machine as defined in claim 2, further comprising a damper, wherein the damper comprises a driving wheel coaxially and synchronically rotatably mounted to the rotary shaft, a damping flywheel mounted to the chassis, and a transmission belt running around between the transmission wheel and the damping flywheel.

4. The free walking training machine as defined in claim 2, further comprising a locking device, wherein the locking device comprises a first slot located at one of the left and right upright linking bars, a second slot located at one of the first and right supporting units and at the same side as the first slot is located, and a pin selectively insertable into the first and second slots, wherein when the pin is inserted into the first and second slots, the left and right axial portions can be prohibited from upward and downward movement relative to the left and right supporting frames.

5. The free walking training machine as defined in claim 2, further comprising at least one springy member, wherein the at least one springy member is mounted between at least one of the left and right upright linking bars and the chassis for providing resilient preload off an upright direction.

6. A free walking training machine comprising:

a chassis having a left supporting frame and a right supporting frame;

a left swing arm having a left treadle and a left axial portion extending laterally;

a right swing arm having a right treadle and a right axial portion extending laterally;

a left lifting mechanism mounted between the left axial portion and the left supporting frame for facilitating the left swing arm to be movable upwardly and downwardly relative to the left supporting frame;

a right lifting mechanism mounted between the right axial portion and the right supporting frame for facilitating the right swing arm to be movable upwardly and downwardly relative to the right supporting frame;

a first linking mechanism connected with the left and right swing arms or connected with the left and right lifting mechanisms for enabling the left and right axial portions to simultaneously move upwardly and downwardly in opposite directions; and a second linking mechanism connected with the left and right swing arms for enabling the left and right swing arms to simultaneously respectively swing about the left and right axial portions in opposite directions;

wherein the first and second linking mechanisms are operable independently from each other;

wherein the second linking mechanism comprises a left pivotable linking bar having an end slidably pivotably connected with the left swing arm, a right pivotable linking bar having an end slidably pivotably connected with the right swing arm, and a linking unit connected with the left and right pivotable linking bars for facilitating the left and right pivotable linking bars to be coaxially and synchronically pivotable in opposite directions.

7. The free walking training machine as defined in claim 6, wherein the linking unit comprises a left rotary shaft connected with the left pivotable linking bar, a right rotary shaft connected with the right pivotable linking bar and coaxial with the left rotary shaft, a left rotary-shaft crank connected with the left rotary shaft, a right rotary-shaft crank connected with the right rotary shaft, a lever, a first pushrod, and a second pushrod, the lever having a first end, a second end, and a fulcrum pivotably connected with the chassis and located between the first and second ends, the first pushrod being connected between the left rotary-shaft crank and the first end of the lever, the second pushrod being connected between the right rotary-shaft crank and the second end of the lever.

8. The free walking training machine as defined in claim 6, wherein the linking unit comprises a left rotary shaft connected with the left pivotable linking bar, a right rotary shaft connected with the right pivotable linking bar, and a bevel gear set connected between the left and right rotary shafts, the bevel gear set having a left bevel gear axially connected with the left rotary shaft, a right bevel hear axially connected with the right rotary shaft, and an intermediate bevel gear mounted to the chassis and engaged with the left and right bevel gears at the same time.

9. The free walking training machine as defined in claim 6, wherein the left pivotable linking bar comprises a left slide sleeve slidably sleeved to the left swing arm, and a left bar having an end pivotably connected with the left slide sleeve; the right pivotable linking bar comprises a right slide sleeve slidably sleeved to the right swing arm, and a right bar having an end pivotably connected with the right slide sleeve; the linking unit is connected with the left and right bars.

10. The free walking training machine as defined in claim 6, wherein the left pivotable linking bar comprises a left slide groove formed at an end thereof; the right pivotable linking bar comprises a right slide groove formed at an end thereof; the left swing arm comprises a left slide member protruding sideward; the right swing arm comprises a right slide member protruding sideward; the left and right slide members are slidably inserted into the left and right slide grooves, respectively.

11. A free walking training machine comprising:

a chassis having a left supporting frame and a right supporting frame;

a left swing arm having a left treadle and a left axial portion extending laterally;

a right swing arm having a right treadle and a right axial portion extending laterally;

a left lifting mechanism mounted between the left axial portion and the left supporting frame for facilitating the left swing arm to be movable upwardly and downwardly relative to the left supporting frame;

a right lifting mechanism mounted between the right axial portion and the right supporting frame for facilitating the right swing arm to be movable upwardly and downwardly relative to the right supporting frame;

a first linking mechanism connected with the left and right lifting mechanisms for enabling the left and right axial portions to simultaneously move upwardly and downwardly in opposite directions; and a second linking mechanism connected with the left and right swing arms for enabling the left and right swing arms to simultaneously respectively swing about the left and right axial portions in opposite directions;

wherein the first and second linking mechanisms are operable independently from each other;

wherein the left lifting mechanism comprises a left slide sleeve slidably mounted to the left supporting frame; the left axial portion is pivotably connected with the left slide sleeve; the right lifting mechanism comprises a right slide sleeve slidably mounted to the right supporting frame; the right axial portion is pivotably connected with the right slide sleeve; the first linking mechanism comprises a left upright linking bar having an end connected with the left slide sleeve, a right upright linking bar having an end connected with the right slide sleeve, a rotary shaft rotatably mounted to the chassis, a left crank having two ends, one of which is synchronically rotatably connected with the rotary shaft and the other is pivotably connected with the left upright linking bar, and a right crank having two ends, one of which is synchronically rotatably connected with the rotary shaft and the other is pivotably connected with the right upright linking bar; an orientation phase difference between the left and right cranks is 180 degrees.

* * * * *